US010590680B2

(12) United States Patent
Mizner et al.

(10) Patent No.: US 10,590,680 B2
(45) Date of Patent: Mar. 17, 2020

(54) GRAVITY LATCH

(71) Applicants: Aaron M. Mizner, Tampa, FL (US); E. Erik Timothy, Apollo Beach, FL (US)

(72) Inventors: Aaron M. Mizner, Tampa, FL (US); E. Erik Timothy, Apollo Beach, FL (US)

(73) Assignee: NATIONWIDE INDUSTRIES, INC., Tampa, FL (US)

( * ) Notice: Subject to any disclaimer, the term of this patent is extended or adjusted under 35 U.S.C. 154(b) by 613 days.

(21) Appl. No.: 15/330,121

(22) Filed: Aug. 10, 2016

(65) Prior Publication Data

US 2017/0152682 A1 Jun. 1, 2017

Related U.S. Application Data

(60) Provisional application No. 62/282,903, filed on Aug. 14, 2015.

(51) Int. Cl.
*E05B 65/00* (2006.01)
*E05C 3/16* (2006.01)
(Continued)

(52) U.S. Cl.
CPC ..... *E05B 65/0007* (2013.01); *E05B 9/08* (2013.01); *E05B 15/025* (2013.01);
(Continued)

(58) Field of Classification Search
CPC ..... Y10T 292/1063; Y10T 292/1064; Y10T 292/1069; Y10T 292/107; Y10T 292/1071;
(Continued)

(56) References Cited

U.S. PATENT DOCUMENTS 134,877 A * 1/1873 Finley ..... E05F 11/00 292/238
204,267 A * 5/1878 Unger ..... E05C 3/30 292/135

(Continued)

FOREIGN PATENT DOCUMENTS

FR 2836946 A1 * 9/2003 ..... E05B 13/004
WO WO 2007070977 * 6/2007
WO WO-2012106764 A1 * 8/2012 ..... E05B 13/002

*Primary Examiner* — Carlos Lugo
(74) *Attorney, Agent, or Firm* — Arthur W. Fisher, III

(57) ABSTRACT

A top pull gravity latch device to selectively secure a gate in a closed position to block the opening or portal in a fence, wall or other barrier comprising a latch assembly including a latch actuator assembly, intermediate pull actuator assembly and pivotal latch member each movable between a first and second position and a keeper assembly including a striker pin to selectively engage the pivotal latch member to move the pivotal latch member from the first to second position when the keeper assembly is moved from the second to first position and back to the first position wherein the gate is securely closed when the latch actuator assembly, intermediate pull actuator assembly, pivot latch member of the latch assembly and the striker pin of the keeper assembly are all in the first position and wherein the intermediate pull actuator assembly is moved from the first to second position to move the pivotal latch member from the first to second position clearing the striker pin of the keeper assembly to be moved from the first to second position to allow the gate to be opened.

12 Claims, 18 Drawing Sheets

(51) Int. Cl.

| | |
|---|---|
| ***E05B 65/52*** | (2006.01) |
| ***E05B 9/08*** | (2006.01) |
| ***E05B 15/02*** | (2006.01) |
| ***E05B 67/38*** | (2006.01) |
| ***E05C 3/06*** | (2006.01) |
| *E05B 65/02* | (2006.01) |

(52) U.S. Cl.
CPC ..... *E05B 65/5292* (2013.01); *E05B 67/383* (2013.01); *E05C 3/06* (2013.01); *E05C 3/165* (2013.01); *Y10T 292/107* (2015.04); *Y10T 292/1063* (2015.04); *Y10T 403/7147* (2015.01)

(58) Field of Classification Search
CPC ..... Y10T 292/1072; Y10T 292/11; Y10T 292/087; Y10T 403/7147; E05B 65/0007; E05B 65/5292
See application file for complete search history.

(56) References Cited

U.S. PATENT DOCUMENTS 217,863 A * 7/1879 Craycraft ..... E05B 63/06 292/26
411,955 A * 10/1889 Ellis ..... E05C 3/30 292/127
487,077 A * 11/1892 Rapson ..... E05B 15/0093 292/230
580,404 A * 4/1897 Keagle ..... E05B 53/001 292/255
727,494 A * 5/1903 Thompson ..... E05B 65/0007 292/148
854,193 A * 5/1907 Betts ..... E05B 65/0007 292/156
876,300 A * 1/1908 Couret ..... E05C 3/30 292/135
1,447,705 A * 3/1923 Anderson ..... E05B 65/0007 292/227
2,074,759 A * 3/1937 Richards ..... E05B 65/0007 292/213
3,282,617 A * 11/1966 Wason ..... E05B 65/0007 292/171
3,871,134 A * 3/1975 Lening ..... E05C 5/00 49/425
3,877,738 A * 4/1975 Nelson ..... E05C 3/24 292/68
3,888,446 A * 6/1975 O'Brien ..... F16B 7/0486 362/431
4,111,475 A * 9/1978 McCormick ..... E05B 65/0007 292/207
4,142,749 A * 3/1979 Heald ..... E05B 65/0007 292/130
4,305,611 A * 12/1981 Robins ..... E05B 63/0056 292/1
4,691,541 A * 9/1987 McQuade, Sr. ..... E05B 65/0007 292/207
4,919,463 A * 4/1990 McQuade ..... E05B 65/0007 292/106
5,024,473 A * 6/1991 McQuade ..... E05B 65/0007 292/106
5,103,658 A * 4/1992 McQuade ..... E05B 65/0007 49/394
5,362,116 A * 11/1994 Doyle ..... E05C 19/163 292/144
5,632,514 A * 5/1997 Johnson, Jr. ..... E05B 65/0014 292/95
5,699,642 A * 12/1997 McDevitt, Jr. ..... E04C 5/162 24/16 PB
6,058,747 A * 5/2000 Doyle ..... E05B 13/105 292/135
6,155,616 A * 12/2000 Akright ..... E05B 5/00 292/198
7,100,405 B2 * 9/2006 West ..... E05B 19/04 292/13
7,201,030 B2 * 4/2007 Timothy ..... E05B 65/0007 292/127
7,520,542 B1 * 4/2009 Price ..... E05B 63/20 256/65.13
8,376,421 B2 * 2/2013 Simmonds ..... E05B 15/101 292/251.5
9,303,435 B2 * 4/2016 Simmonds ..... E05C 1/08
9,523,219 B2 * 12/2016 Macernis ..... E05B 47/004
9,803,396 B2 * 10/2017 Timothy ..... E05B 65/0007
2005/0210938 A1 * 9/2005 Doyle ..... E05C 19/163 70/276
2006/0267352 A1 * 11/2006 Childress ..... E05B 65/0007 292/246
2007/0175249 A1 * 8/2007 Karcz ..... E05B 65/0007 70/101
2007/0175250 A1 * 8/2007 Karcz ..... E05B 65/0007 70/101
2010/0032966 A1 * 2/2010 Taglianetti ..... E05B 1/0046 292/217
2011/0148126 A1 * 6/2011 Macernis ..... E05B 65/0007 292/251.5

* cited by examiner

GRAVITY LATCH

CROSS-REFERENCE

This application is a nonprovisional utility application claiming priority of provisional application filed Aug. 14, 2015 assigned application Ser. No. 62/282,903.

BACKGROUND OF THE INVENTION

Field of the Invention

A gravity gate latch device to secure a gate in the closed position to block an opening in a fence or other barrier.

Description of the Prior Art

Numerous gate latches have been designed to block or secure openings in fences or other inclosing barriers. Such designs include both gravity operated latches and magnetic latch devices.

Examples of gravity operated or similar latch devices or assemblies are found in U.S. Pat. Nos. 2,767,007; 3,040,555; 3,691,799; 3,705,505; 4,073,520; 4,083,591; 4,124,954; 2,284,370; US 2007/0175250 and US 2010/0148523.

Examples of magnetic latch devices can be found in U.S. Pat. Nos. 8,376,421; 5,362,116; 5,664,769; 7,044,511; 7,100,405; 5,114,195; 5,490,698; 5,823,026; 6,155,616; 6,666,435 and 7,390,035.

SUMMARY OF THE INVENTION

The present invention relates to a gravity latch device comprising a latch assembly mounted to a fence post adjacent an opening or portal in a fence, wall or other barrier and a keeper assembly attached to a gate post of a gate movable between an open position and a closed position to close or block the opening or portal when the gate is closed.

The latch assembly comprises a latch actuator assembly disposed to selectively engage a pivotal latch member.

The latch actuator assembly comprises an upper actuator pull knob and an elongated interconnecting member including having a pivot latch engaging surface.

A keeper latch assembly pivotally supports the pivotal latch member including a striker pin recess to selectively receive a striker pin of the keeper assembly to maintain the gate in the closed position.

The pivotal latch member a knob to selectively engage the pivot latch engaging member to selectively control the movement and position of the striker pin.

A latch mount assembly and a striker pin mount assembly may include an arcuate or concave base having a radius of curvature equal to or less than the radius of the fence post and gate post respectively mounted to the fence post and the gate post.

The gravity latch device may further include a latch locking assembly to prevent unauthorized opening of the gate. In particular, the latch locking assembly comprises a first lock member or plate having a first lock receiving aperture extending outwardly therefrom and an upper hollow actuator pull knob shroud movable between a first or unlocked position and a second or locked position including a hollow sleeve having a second lock member or flange and a cap or top having a centrally disposed aperture formed therethrough to selectively receive the upper portion of the elongated interconnecting member of the latch actuator assembly when the upper hollow actuator pull knob shroud is in the first or lower position.

The gravity latch device is operable in at least two (2) configurations. The first closed or secured configuration is when the gate is securely closed with the latch assembly is in a first position, and the pivotal latch member and the striker pin are also in a first position with the striker pin disposed within the striker pin recess. The second open or released configuration is when the gate can be swung open with latch actuator assembly and moved from the first position to a second position the latch engaging member or surface engages the latch actuator surface of the inner latch member to rotate the pivotal latch member form the first or striker pin retaining position to the second position clearing the striker pin from the striker pin recess allowing the gate to be opened.

The latch securing assembly is operable in a first or unlocked configuration and a second or locked configuration.

When in the first or unlocked configuration, the upper hollow actuator pull knob shroud is in first or lower position such that the upper actuator pull knob extends or is disposed above the upper hollow actuator pull knob shroud so that the latch assembly may be pulled upward from the first to second position causing the latch engaging member or lower surface of the latch actuator to engage the latch actuator surface of the pivotal latch member rotating the pivotal latch member from the first to second position allowing the striker pin of the keeper assembly to clear the pivot latch member such that the gate can swing open.

When in the second or locked configuration, the upper hollow actuator pull knob shroud is in the second or upper position such that the upper actuator pull knob or member is disposed within the upper hollow actuator pull knob shroud to prevent access to the upper actuator pull knob or member. The first lock receiving aperture and the second lock aperture are axially aligned relative to each other to receive a pad lock or similar locking device to lock or secure the upper hollow actuator pull knob shroud in the second or upper position to maintain the latch locking assembly in the locked configuration.

Due to the size and shape of the latch mount assembly and the striker latch mount assembly, the gravity latch device can be mounted to fence posts and gate posts of various sizes and shapes without modifying the structure of the top pull gravity latch device or any of the structural components.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
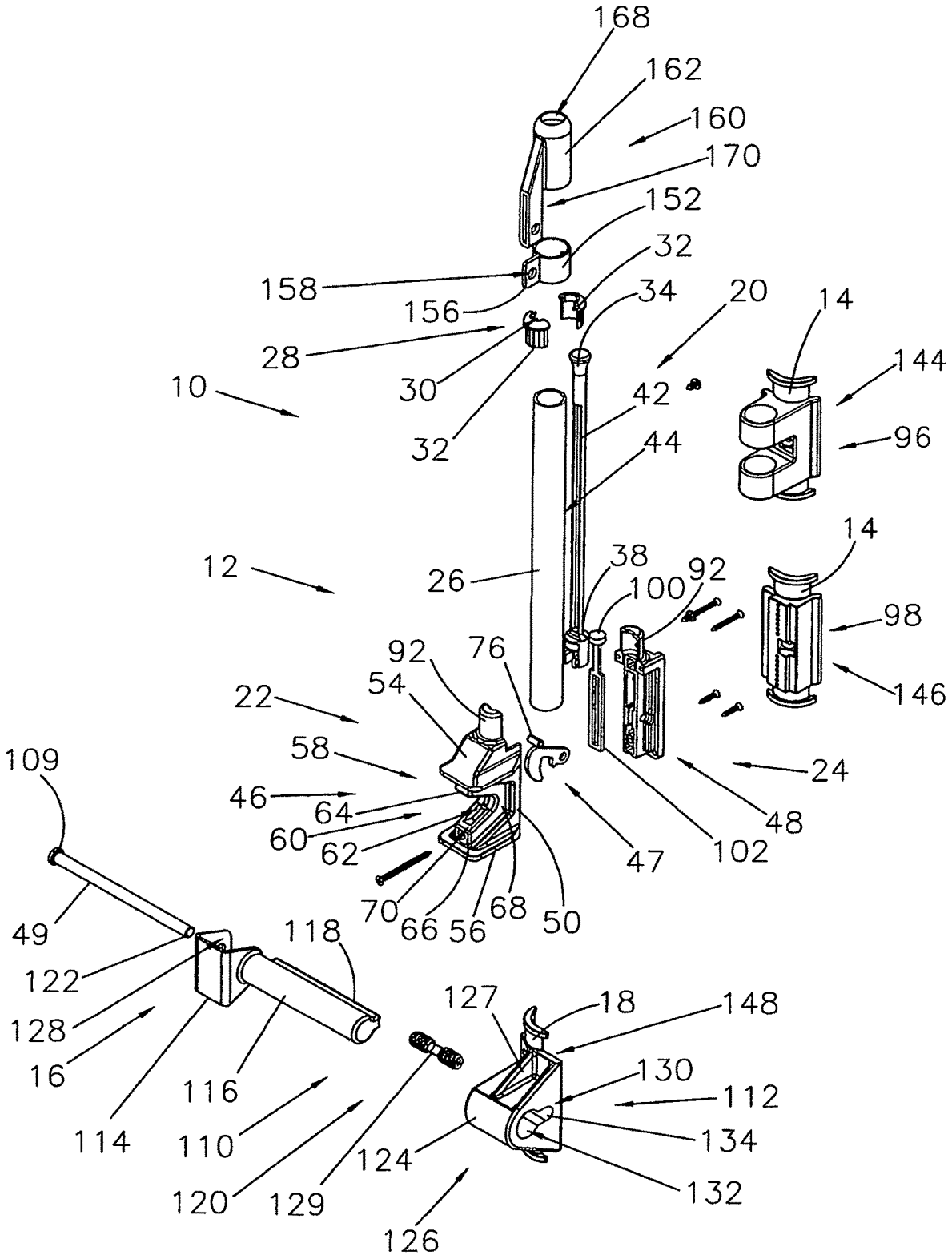
FIG. 1 is an exploded view of the top pull gravity latch device of the present invention.
Figure 2:
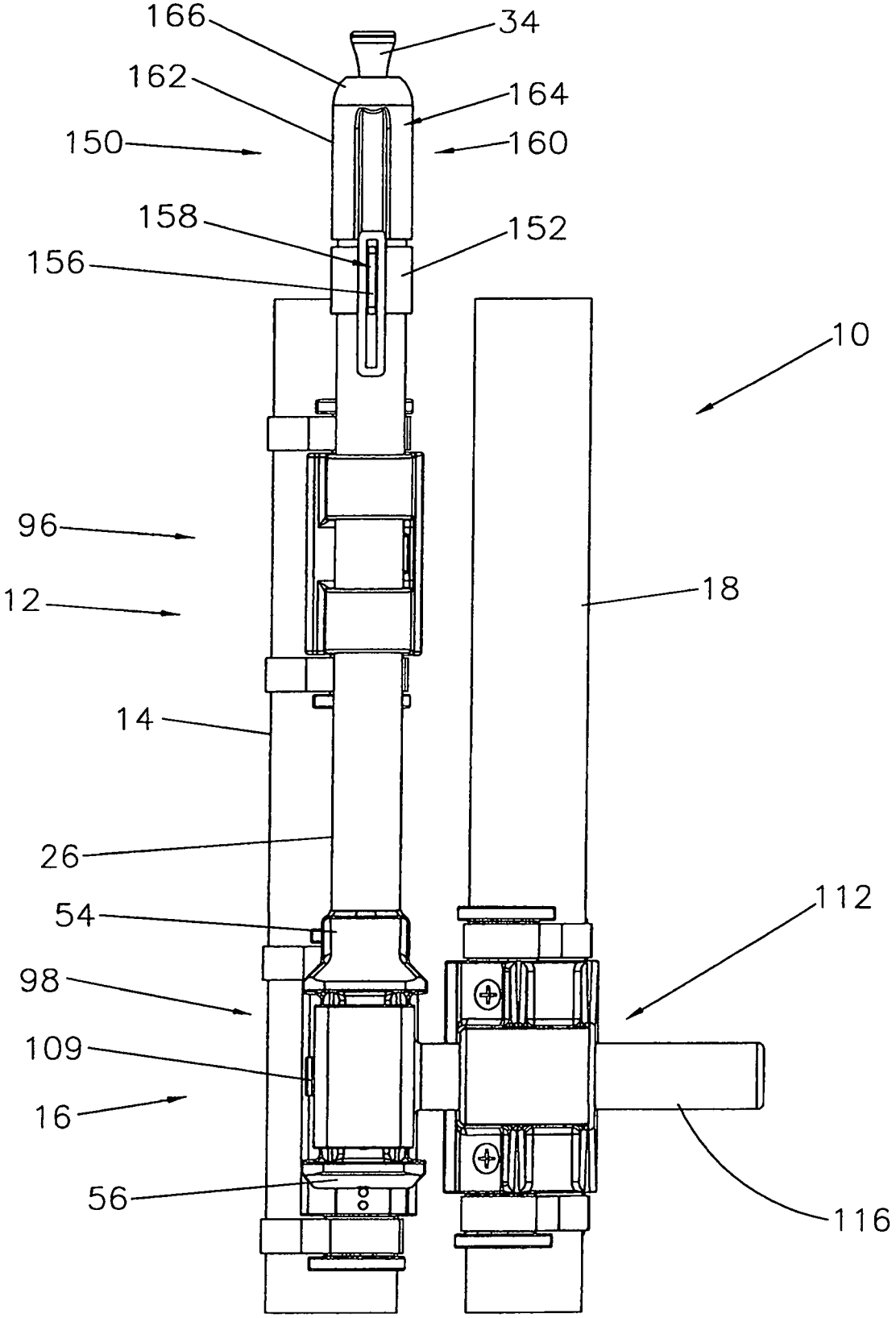
FIG. 2 is a front view of the top pull gravity latch device of the present invention.
Figure 3:
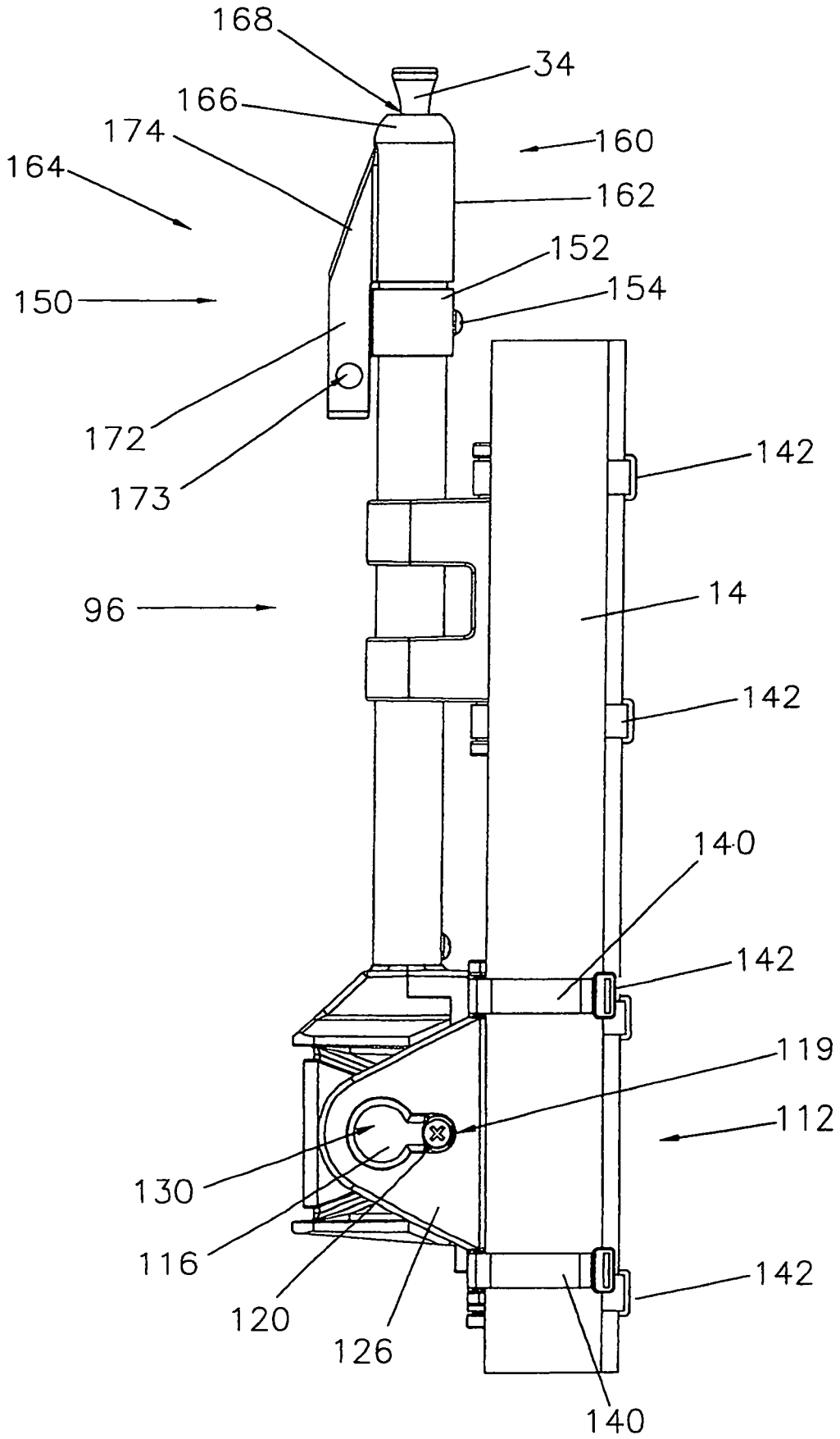
FIG. 3 is a side view of the top pull gravity latch device of the present invention.
Figure 4:
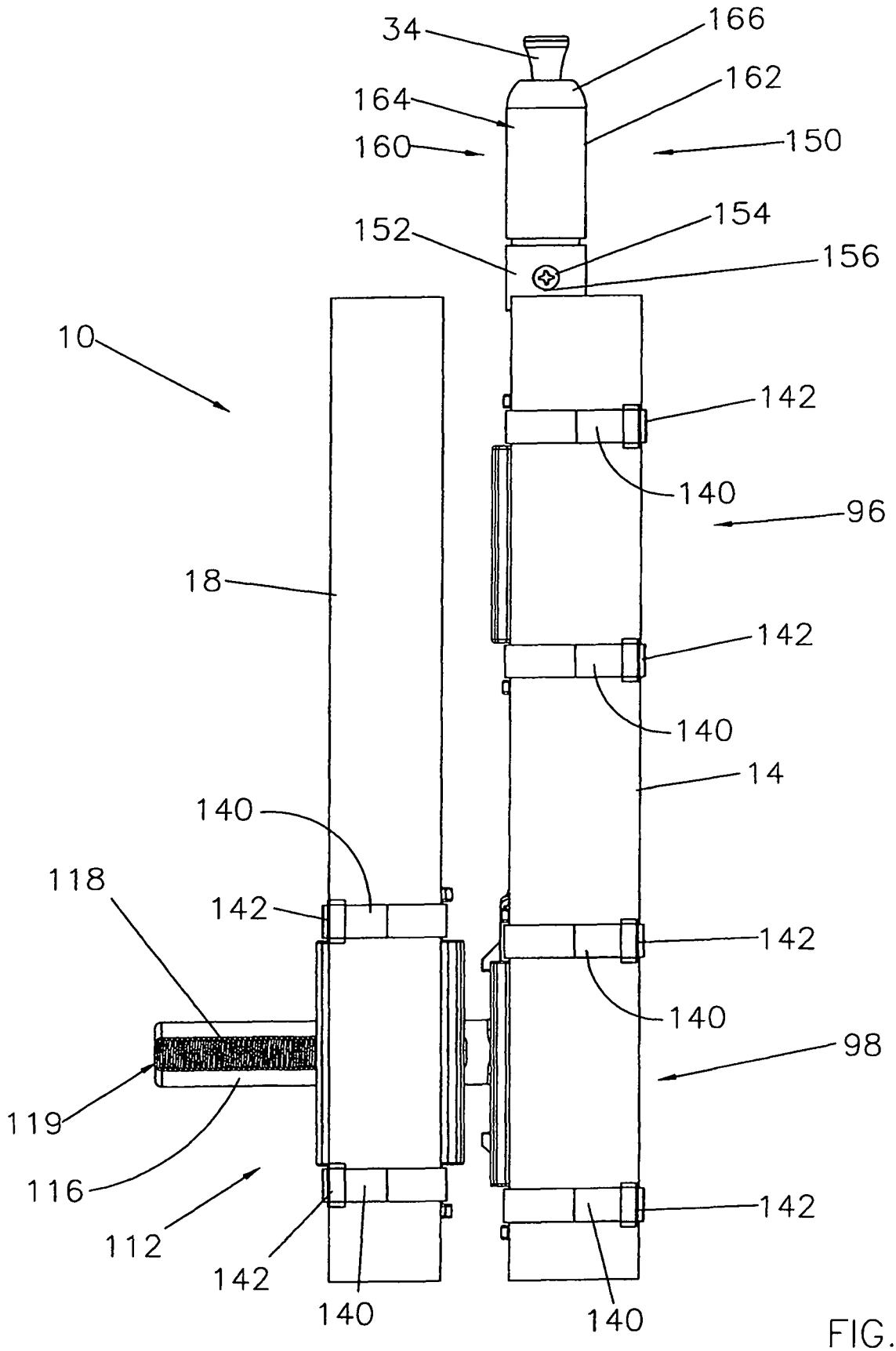
FIG. 4 is a rear view of the top pull gravity latch device of the present invention.
Figure 5:
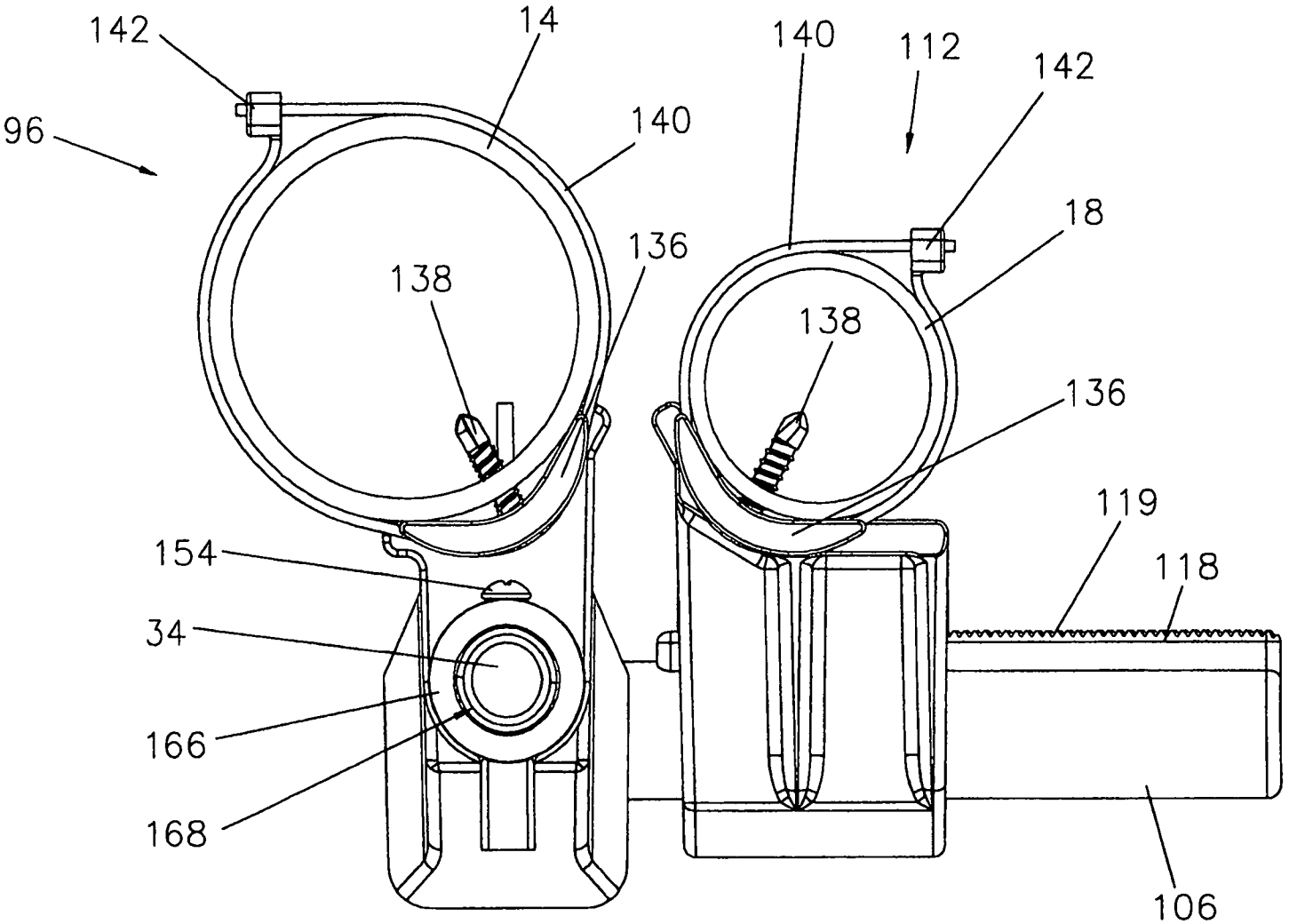
FIG. 5 is a top view of the top pull gravity latch device of the present invention.
Figure 8:
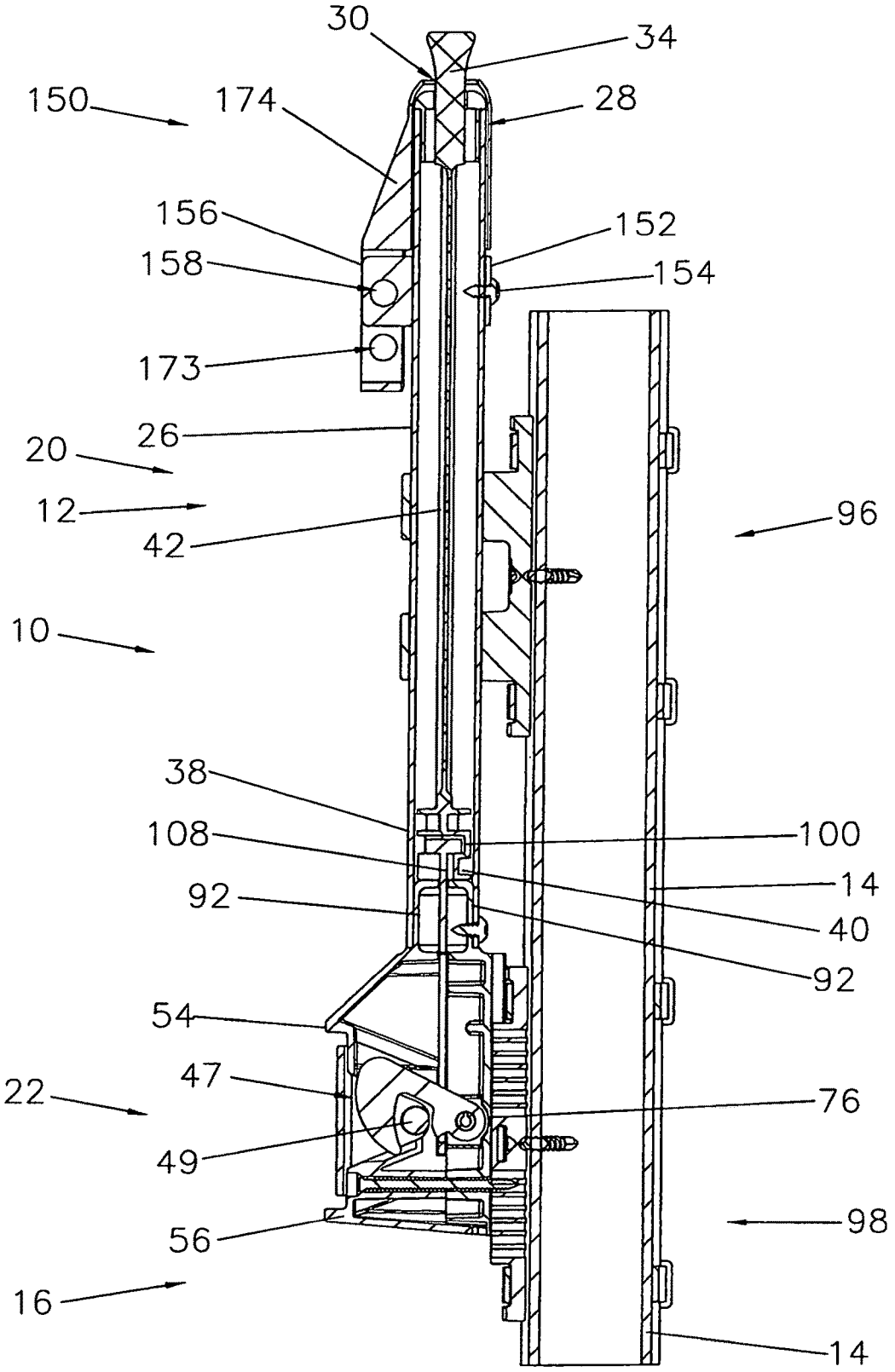
FIG. 8 is a cross-sectional side view of the top pull gravity latch device of the present invention with the latch in the locked position.

As best shown in FIGS. 1 and 8, the present invention relates to a top pull gravity latch device generally indicated as 10 comprising a latch assembly generally indicated as 12 mounted to a fence post 14 (see FIGS. 2 through 5) adjacent an opening or portal in a fence, wall or other barrier (not shown) and a keeper assembly generally indicated 16 attached to a gate post 18 (see FIGS. 2 through 5) of a gate (not shown) movable between an open position and a closed position to close or block the opening or portal (not shown) when the gate (not shown) is closed.

As best shown in FIGS. 1 and 8, the latch assembly 12 comprises a latch actuator assembly generally indicated as 20 disposed to selectively engage a keeper latch assembly generally indicated as 22 including a pivot latch member 47 to pivot the pivot latch member 47 between a locked position and an open position.

The latch actuator assembly 20 is at least partially disposed within a latch assembly housing comprising a hollow sleeve 26 and an upper cap or tap generally indicated as 28 having a centrally disposed hole 30 formed therein to receive the upper portion of the latch actuator assembly 20 therethrough. As shown, the upper cap or tap 28 may comprise two (2) halves or shells each indicated as 32.

Figure 6:
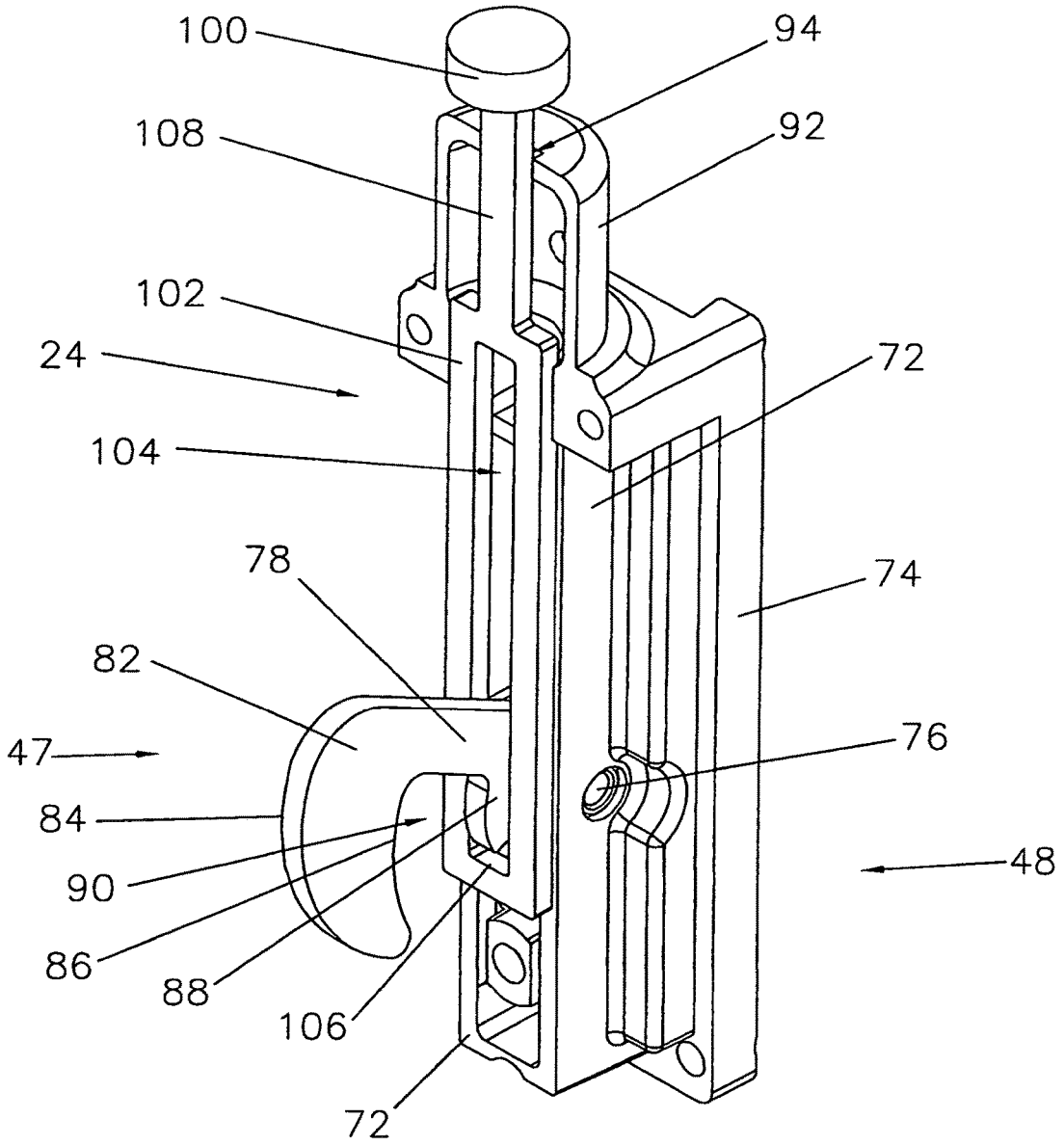
FIG. 6 is a detailed perspective view of the latch assembly of the present invention.
Figure 7:
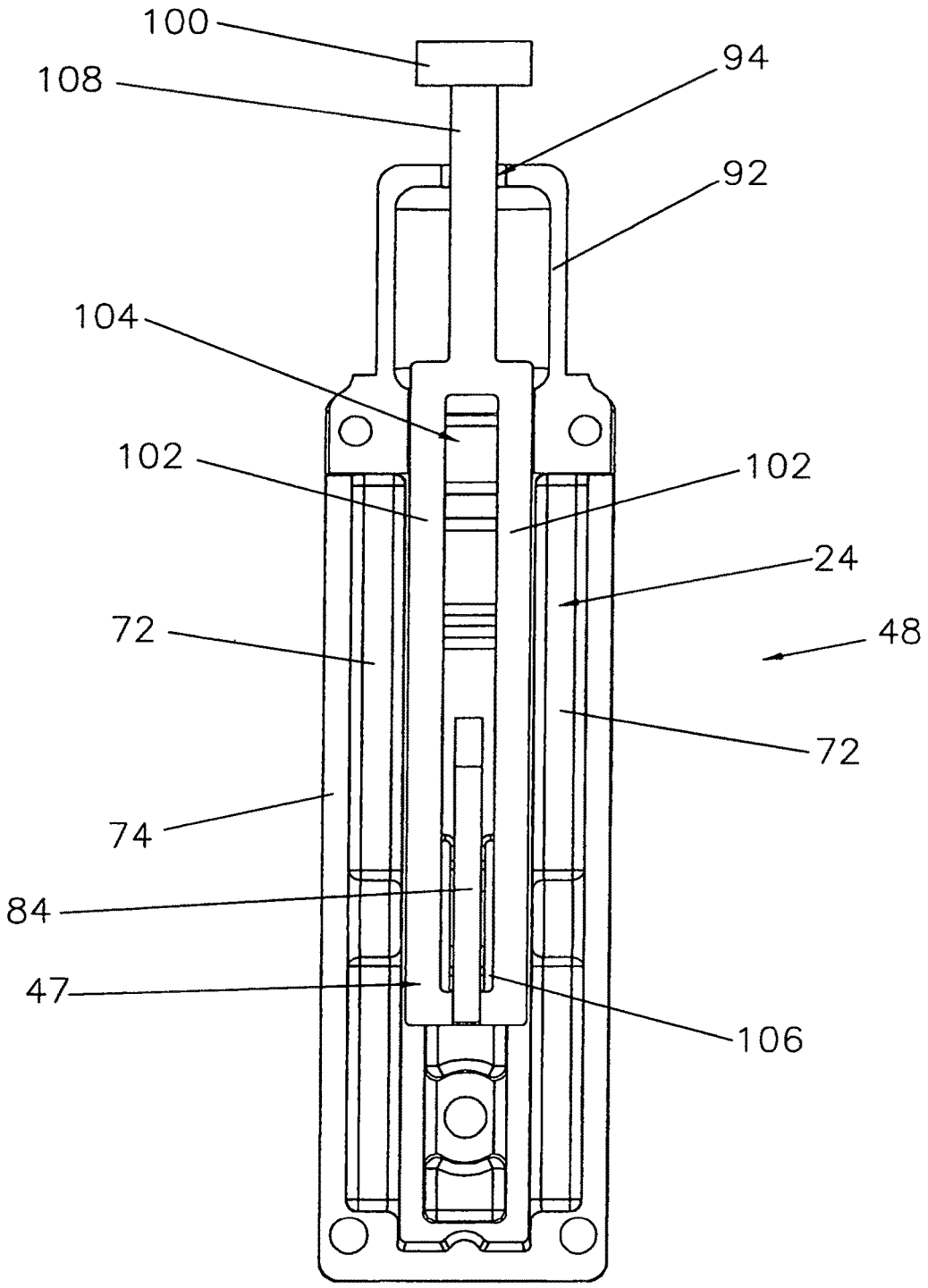
FIG. 7 is a detailed front view of the latch assembly of the present invention.

The latch actuator assembly 20 comprises a pull knob or member 34/100 and a pivot latch actuator assembly generally indicated as 24. The pivot latch actuator assembly 24 may comprise a single elongated member 102 attached to the pull knob or member 34/100 including a slot 104 to receive the pivot latch member 47 therethrough as shown in FIGS. 6 and 7. Alternately, the pivot latch actuator assembly 24 may comprise an elongated interconnecting member 42 including an elongated slot 44 formed therethrough attached to the pull knob or member 34 and a latch actuator 102 including a slot 104 to receive the pivot latch member 47 therethrough coupled to the elongated interconnecting member 42 by an inverted cup 38 including a retainer ledge 40 to support a disc 100 formed on the latch actuator 102.

The keeper latch assembly 22 comprises an outer base generally indicated as 46 and an inner frame generally indicated as 48 to pivotally support a pivotal latch member generally indicated as 47 and to selectively receive a striker pin 49 of the keeper assembly 16 as described hereinafter.

Figure 9:
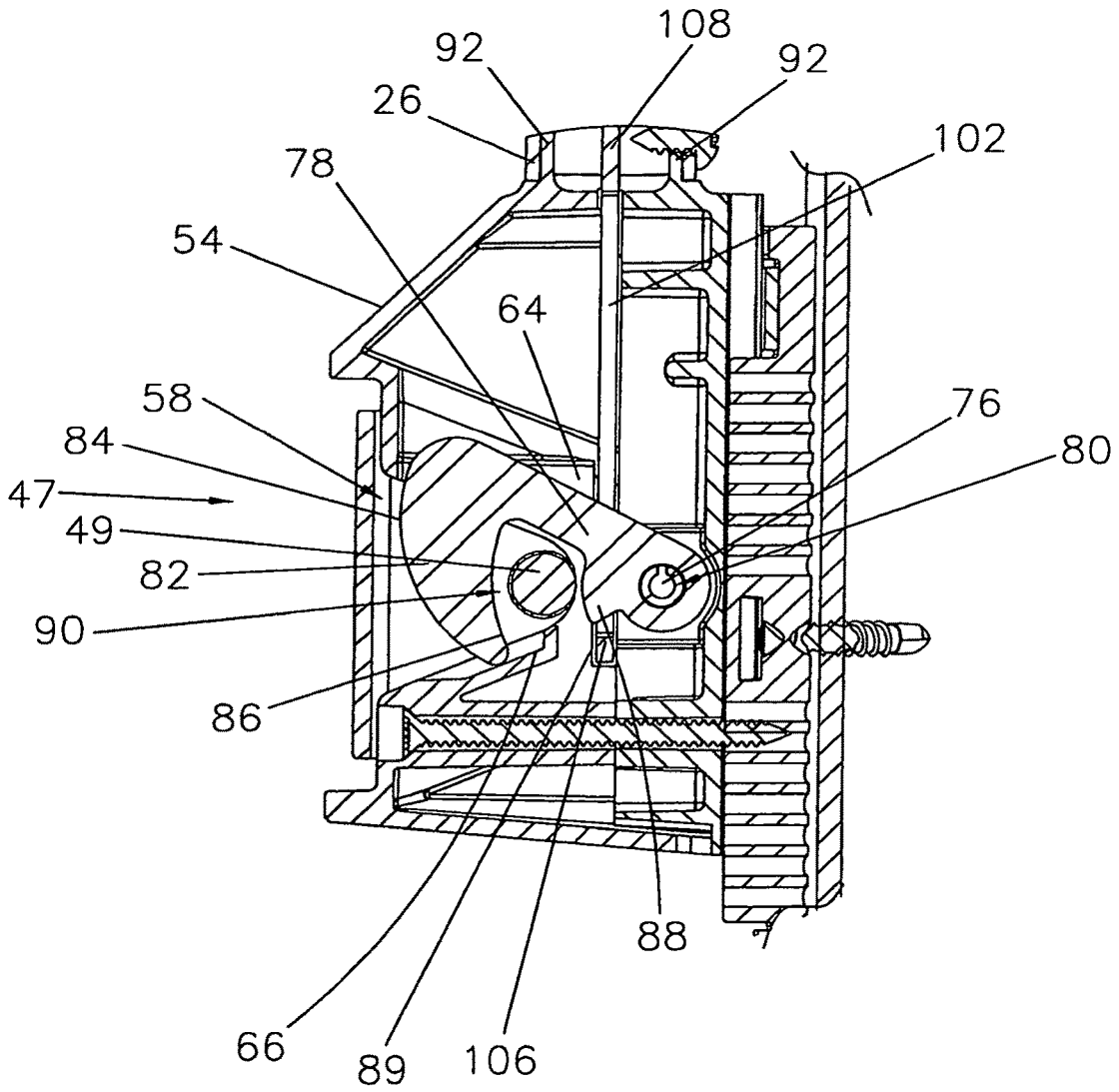
FIG. 9 is a detailed cross-sectional side view of the lower portion of the latch assembly and the keeper assembly of the present invention with the latch in the locked position.

The outer base 46 comprises a substantially vertical back plate 50 including a substantially vertical latch receiving slot 52 formed therethrough having an upper member 54 and a lower member 56 extending outwardly therefrom to cooperatively form an opening 58 therebetween to receive a striker pin receiver generally indicated as 60 comprising a forward projecting groove or open jaw 62 formed by a substantially V-shaped member comprising an upper groove or jaw member 64 and a lower groove or jaw member 66 fixed in spaced relationship relative to each other by a substantially vertical rear groove member 68 including a substantially vertical latch receiving slot 70 aligned with the substantially vertical latch receiving slot 52 formed through the substantially vertical back plate 50 of the outer base 46 of the keeper latch assembly 22. As best shown in FIGS. 8 and 9, the striker pin 49 is disposed within the space or striker pin recess 90 when the keeper assembly 16 is secured or retained by the latch assembly 12 when the gate (not shown) is closed.

The inner frame 48 comprises a pair of substantially vertical side frame members each indicated as 72 held in spaced relationship relative to each other by an inverted substantially L-shaped bracket generally indicated as 74 to pivotally support the pivotal latch member 47 between the pair of substantially vertical side frame member 72 on a latch pivot pin 76.

The pivotal latch member 47 comprises an inner lever arm 78 including a hole 80 formed therethrough to receive the pivot pin 76 having an outer hook member 82 formed on the outer end portion thereof including an outer substantially arcuate or convex striker pin cam surface 84, an inner substantially arcuate or concave striker pin retainer surface 86 and an inner member 88 extending downwardly from the midportion thereof including a latch actuator surface 89 to form a striker pin recess 90 therebetween to selectively control the movement and position of the striker pin 49 as described hereinafter.

A hollow housing receiving post generally indicated as 91 comprising a shell 92 extends upwardly from both the outer base 46 the and inner frame 48 such that when assembled cooperatively form the hollow housing receiving post 91 having centrally disposed hole 94 therebetween to receive a portion of the actuator assembly 24 therethrough.

The latch assembly 12 is coupled or mounted to the fence post 14 by an upper latch mount assembly generally indicated as 96 and a lower latch mount assembly generally indicated as 98.

As previously described, the pivot latch actuator assembly 24 may comprise a substantially vertical elongated member 102 including a longitudinal slot 104 formed therethrough receive the pivot latch member 47 therethrough (FIGS. 6 and 7).

Alternately as previously described, the actuator assembly 24 may comprise a substantially horizontal upper disk 100 disposed within a lower inverted cup 38 of the latch actuator assembly 20 to rest on or engage the upper surface of a retainer ledge or shelf 40 and a substantially vertical latch actuator 102 having a latch slot 104 formed therethrough to receive a portion of the pivotal latch member 47 therethrough (FIGS. 7 and 8). A pivot actuator surface 106 is formed at the lower end portion of the latch slot 104 of the substantially vertical latch actuator 102 to selectively engage the latch actuator surface 89 of the inner latch member 88 of the pivotal latch member 47 to selectively move the pivotal latch member 47 from the latch secured position to the latch released position coupled by a substantially vertical interconnecting member 108 extending through the centrally disposed hole 94 cooperatively formed by the shells 92 of the keeper latch assembly 22 (FIGS. 9 through 12).

As previously described, the actuator assembly 24 may comprise multiple structural elements (FIGS. 1 and 8) or combined as a single member or assembly (FIGS. 6 and 7).

As shown in FIGS. 1 through 4, the keeper assembly 16 comprises the substantially horizontal strike pin 49 including an enlarged end plate or member 109 and a coupling assembly generally indicated as 110 mounted to the gate post 18 by a keeper mount assembly generally indicated as 112. The coupling assembly 110 comprises an inner substantially U-shaped bracket 114 having a substantially cylindrical outer substantially horizontal connector 116 having a striker pin alignment key 118 including a plurality of adjustment threads generally indicated as 119 formed on the surface thereof extending outwardly from the surface thereof to engage the keeper mount assembly 112 to align the coupling assembly 110 relative to the keeper latch assembly 22. The distance the striker pin 49 extends laterally from the gate post 18 may be adjusted by an externally threaded adjustment member 120 held in place on a mounting bracket 126 by a ridge 127 formed on the mounting bracket 126 and a recess or non-threaded portion 129 formed on the externally threaded adjustment member 120 and the external adjustment threads 119 formed on the striker pin alignment key 118. A striker pin alignment keyway generally indicated as 130 comprising substantially circular holes 132 to receive substantially cylindrical outer substantially horizontal connector 116 therethrough and reduced opening or notches 134 to receive the striker pin alignment key 118 therethrough is formed through the mounting bracket 126 to receive the alignment key 118 to align the keeper assembly 16 relative to the keeper latch assembly 22.

The upper latch mount assembly 96 and lower latch mount assembly 98, and the keeper mount assembly 112 may include an arcuate or concave footing or base 136 having a radius of curvature equal to or less than the radius of the fence post 14 and gate post 18 respectively affixed to the fence post 14 and the gate post 18 by a fastener such as a screw 138 in combination with a flexible tie element 140 such as a band or strap and tightly secured around the fence post 14 and the gate post 18 by a tie fastener 142.

As shown in FIG. 1, the upper latch mount assembly 96 and the lower latch mount assembly 98, and the keeper mount assembly 112 may be affixed to or mounted on the latch actuator assembly 20, the keeper latch assembly 22 and the keeper assembly by different attachment structures indicated generally as a latch actuator assembly attachment, a keeper latch assembly attachment and a keeper assembly attachment 144, 146 and 148 respectively.

Figure 13:
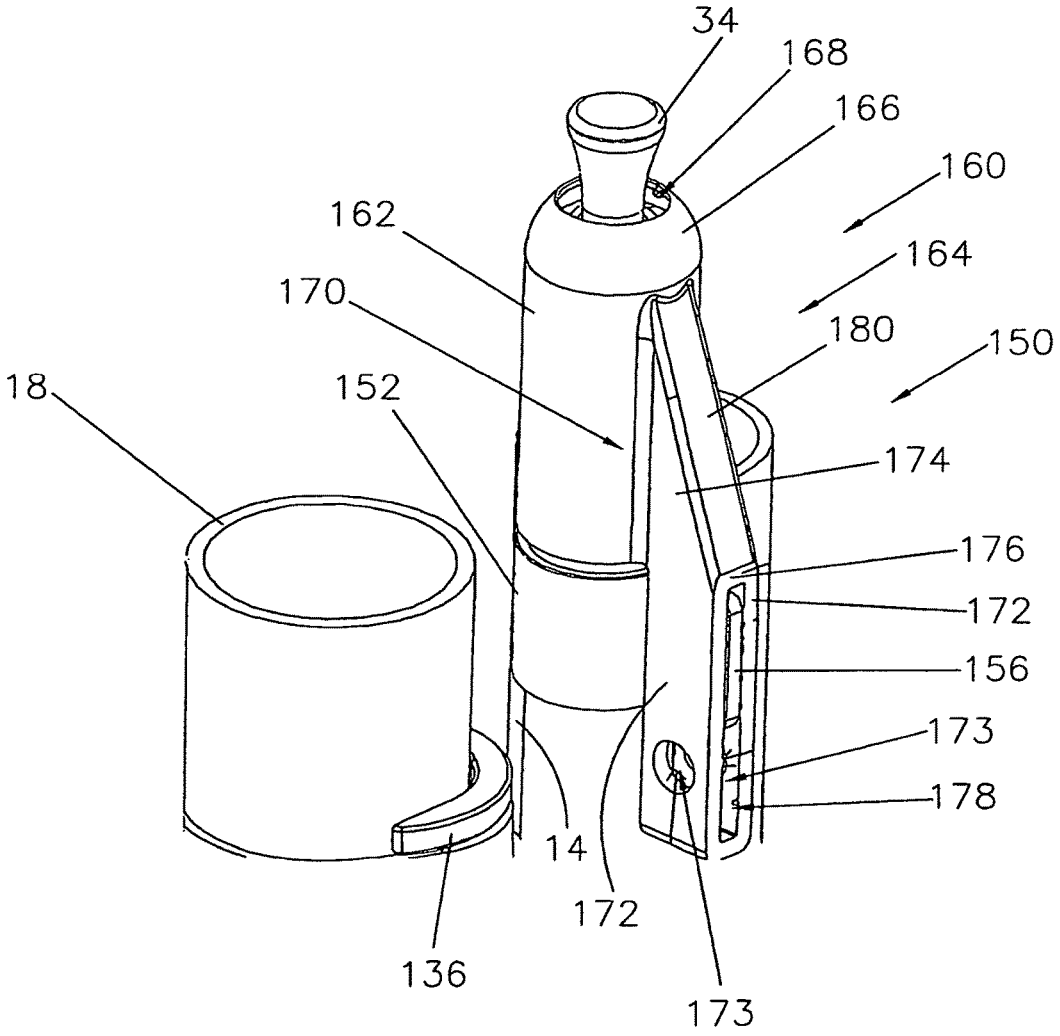
FIG. 13 is a perspective view of the pull lock in the unlocked position.

As best shown in FIGS. 13 though 18, the gravity latch device 10 may further include a latch locking assembly generally indicated as 150 to prevent unauthorized opening of the gate or door (not shown). In particular, the latch locking assembly 150 comprises a lower attachment ring 152 affixed or coupled to the hollow sleeve 26 of the latch assembly housing 26 by a fastener 154 such as a screw including a first lock member or plate 156 having a lock receiving aperture 158 extending outwardly therefrom and an upper hollow actuator pull knob shroud generally indicated as 160 movable between a first or unlocked position (FIGS. 13 and 15) and a second or locked position (FIGS. 16 through 18) including a substantially cylindrical hollow sleeve 162 having a second lock member or flange generally indicated as 164 and a cap or top 166 having a centrally disposed aperture 168 formed therethrough to selectively receive the upper portion of the elongated interconnecting member 42 of the latch actuator assembly 20 therethrough when the upper hollow actuator pull knob shroud 160 is in the first or lower position.

The second lock member 164 comprises a pair of substantially vertical parallel side walls each generally indicated as 170 and including a substantially vertical lower substantially rectangular portion 172 having a lock aperture 173 formed through the lower portion thereof and an upper substantially triangular portion 174 extending outwardly from the substantially cylindrical sleeve 162 and a substantially vertical lower outer end wall 176 extending between the substantially vertical lower substantially rectangular portion 172 having a substantially vertical slot 178 to receive the first lock member or plate 156 therein and a substantially diagonal upper outer end wall 180 extending between the substantially cylindrical hollow sleeve 162 and the substantially vertical lower outer end wall 176.

The gravity latch device 10 is operable in at least two (2) configurations. The first closed or secured configuration is when the gate (not shown) is securely closed with the intermediate pull actuator assembly 24 and the latch actuator assembly 20 of the latch assembly are in a first position, and the pivotal latch member 47 and the striker pin 49 are also in a first position with the striker pin 49 disposed within the striker pin recess 90 (FIGS. 8 and 9). As previously described the latch actuator assembly 20 and intermediate pull actuator assembly 24 may comprise a single structural assembly referred to as the latch actuator assembly 20. The second open or released configuration is when the gate (not shown) can be swung open with latch actuator assembly 20 and intermediate pull actuator assembly 24 of the latch assembly 12 is moved from the first position to a second position the latch engaging member or surface 106 engages the latch actuator surface 89 of the inner latch member 88 to rotate the pivotal latch member 47 from the first or striker pin retaining position to the second position clearing the striker pin 49 from the striker pin recess 90 allowing the gate (not shown) to be opened (FIG. 12).

Figure 15:
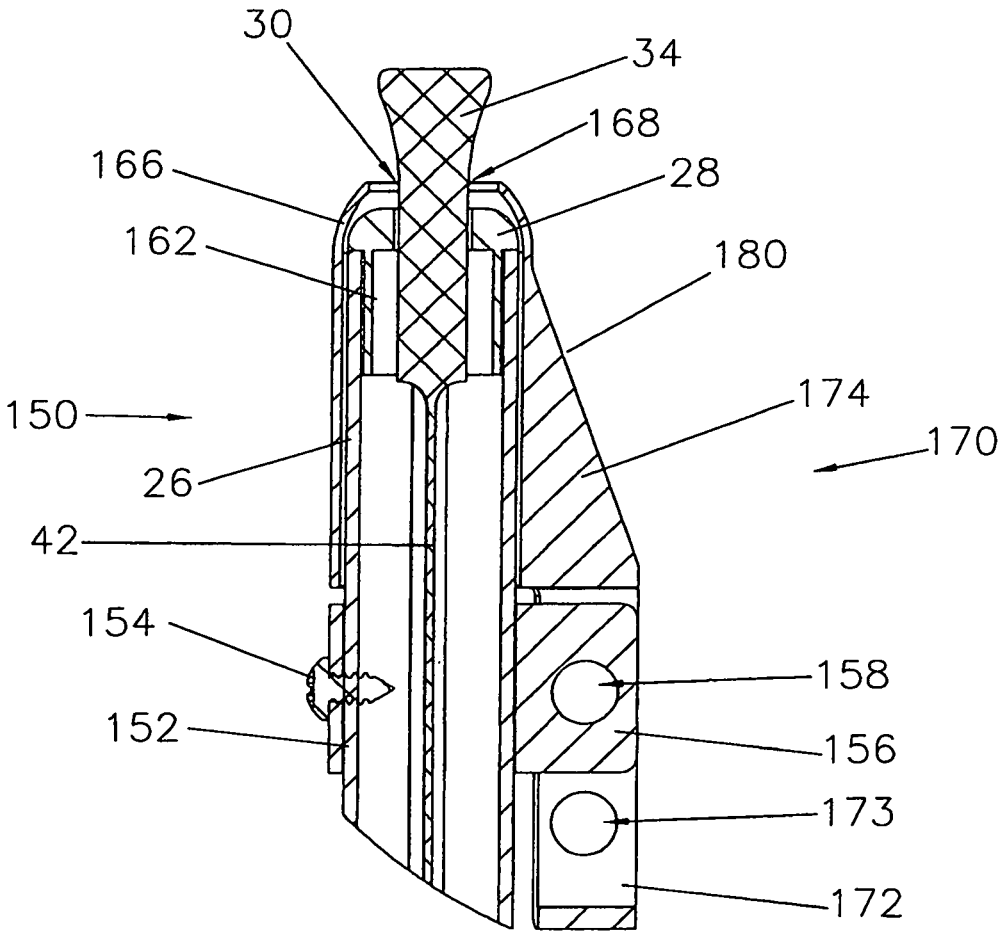
FIG. 15 is a cross-sectional side view of the pull lock in the unlocked position.
Figure 16:
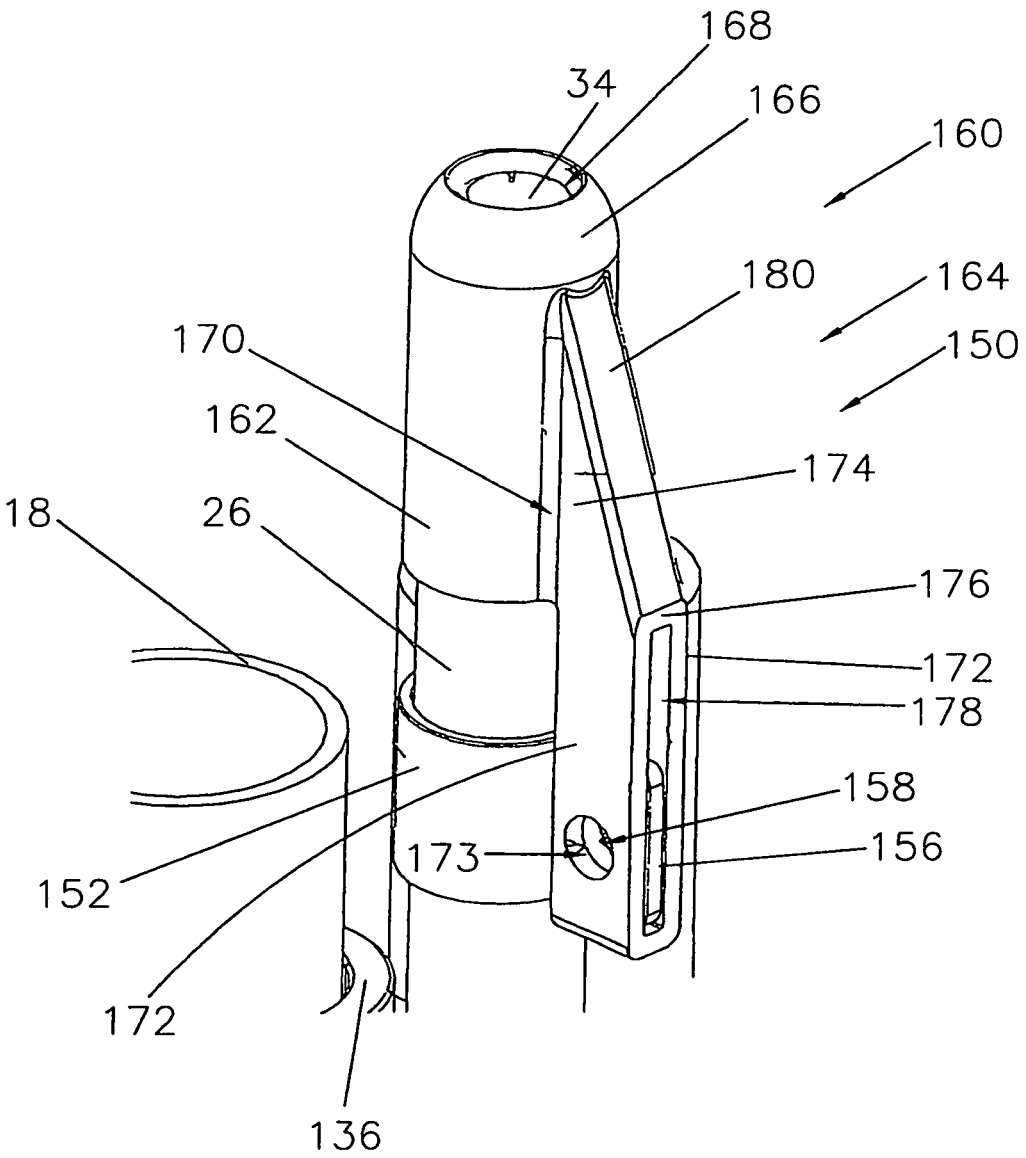
FIG. 16 is a perspective view of the pull lock in the locked position.
Figure 17:
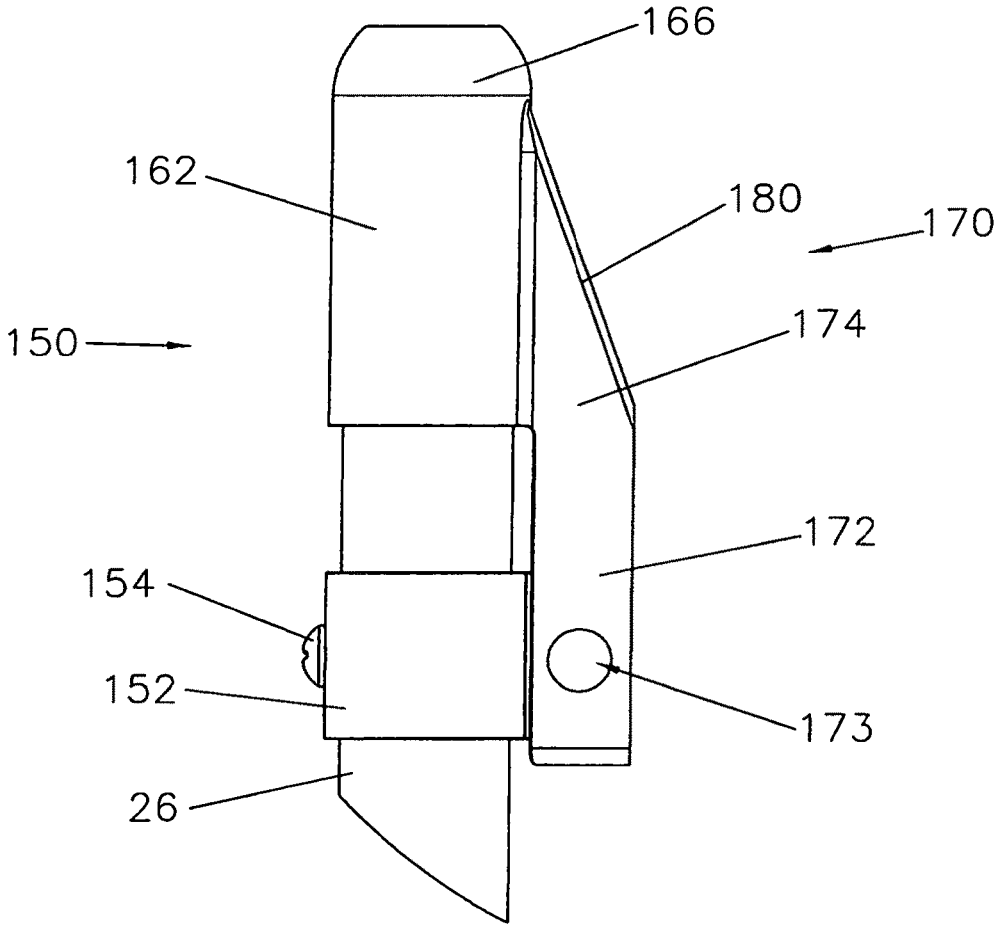
FIG. 17 is a side view of the pull lock in the locked position.
Figure 18:
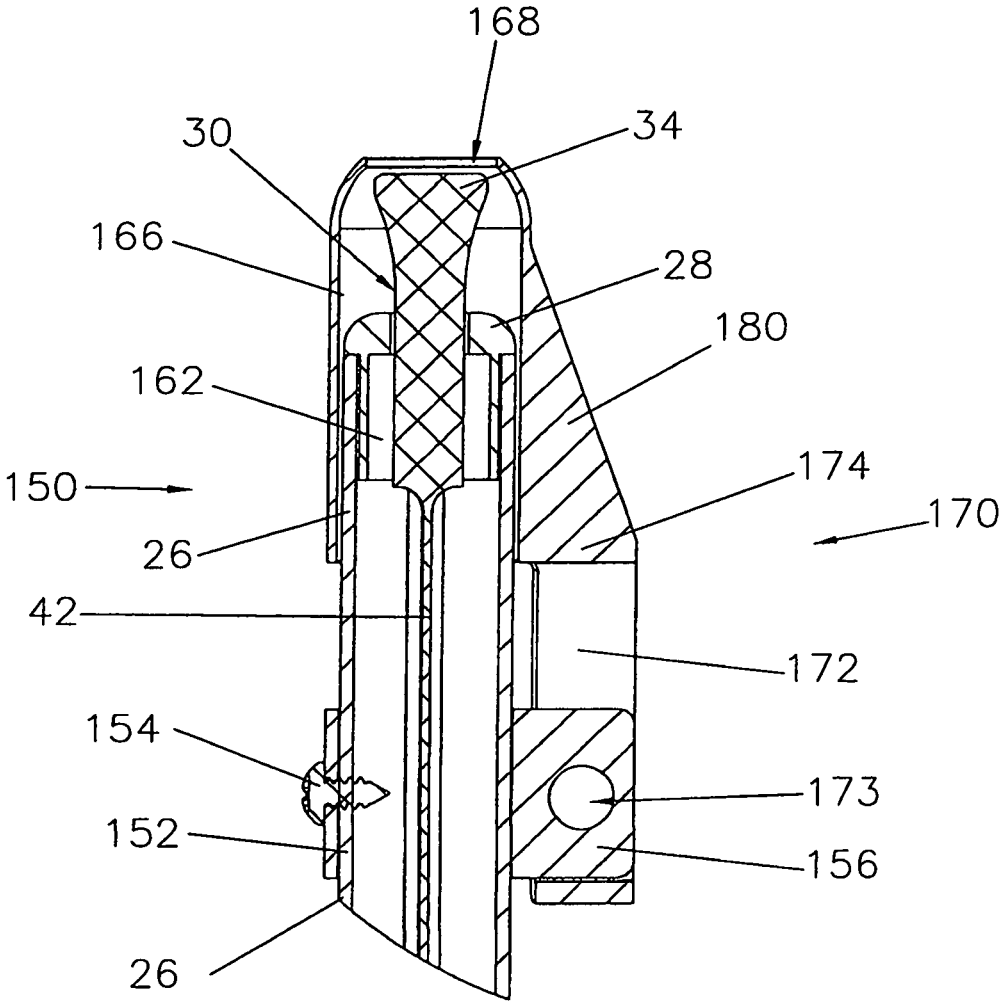
FIG. 18 is a cross-sectional side view of the pull lock in the locked position.

The latch securing assembly 150 is operable in a first or unlocked configuration (FIGS. 13 through 15) and a second or locked configuration (FIGS. 16 through 18).

Figure 12:
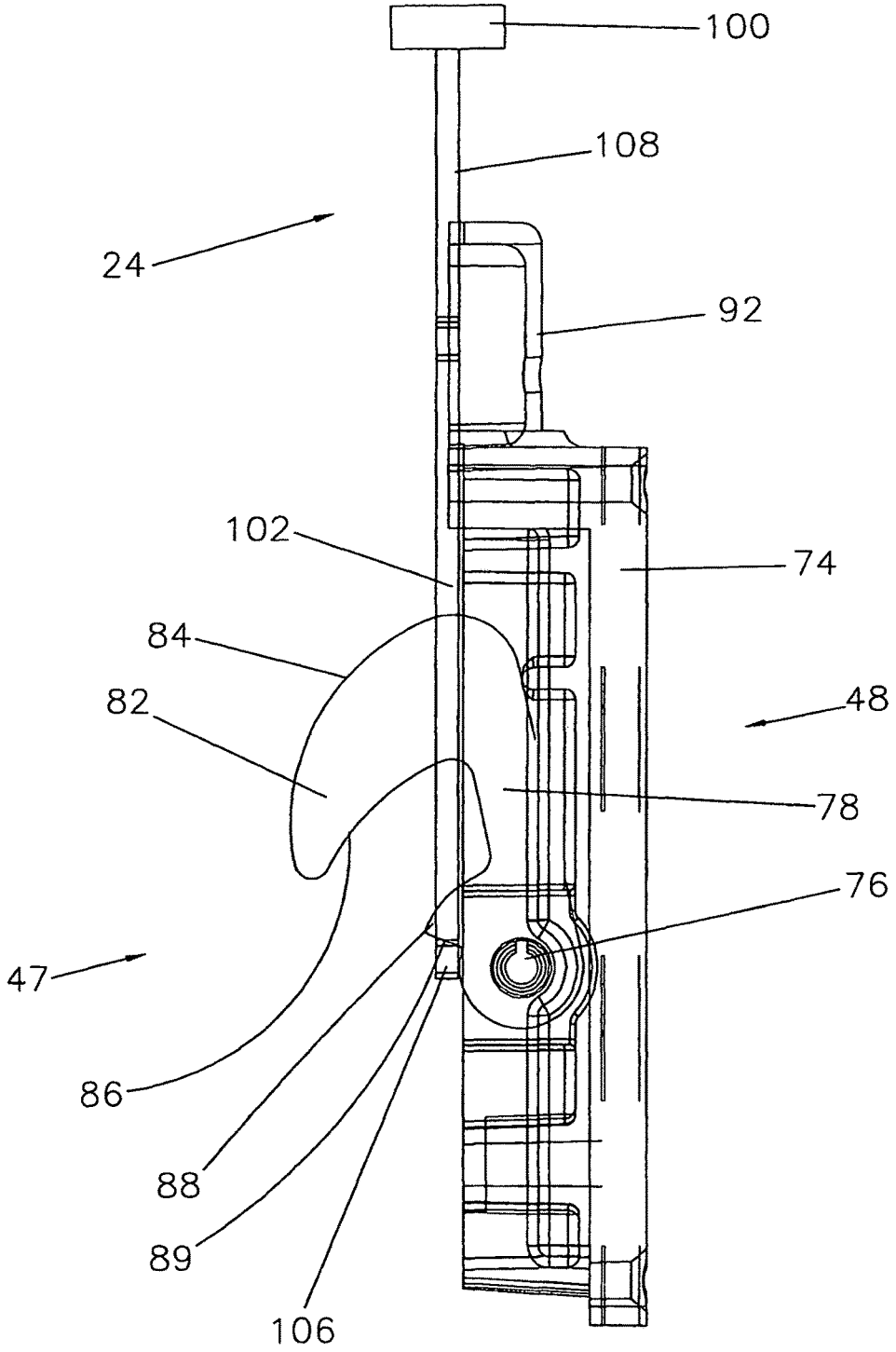
FIG. 12 is a side view of the latch assembly with the latch member of the present invention with the latch member in the top pull position.
Figure 14:
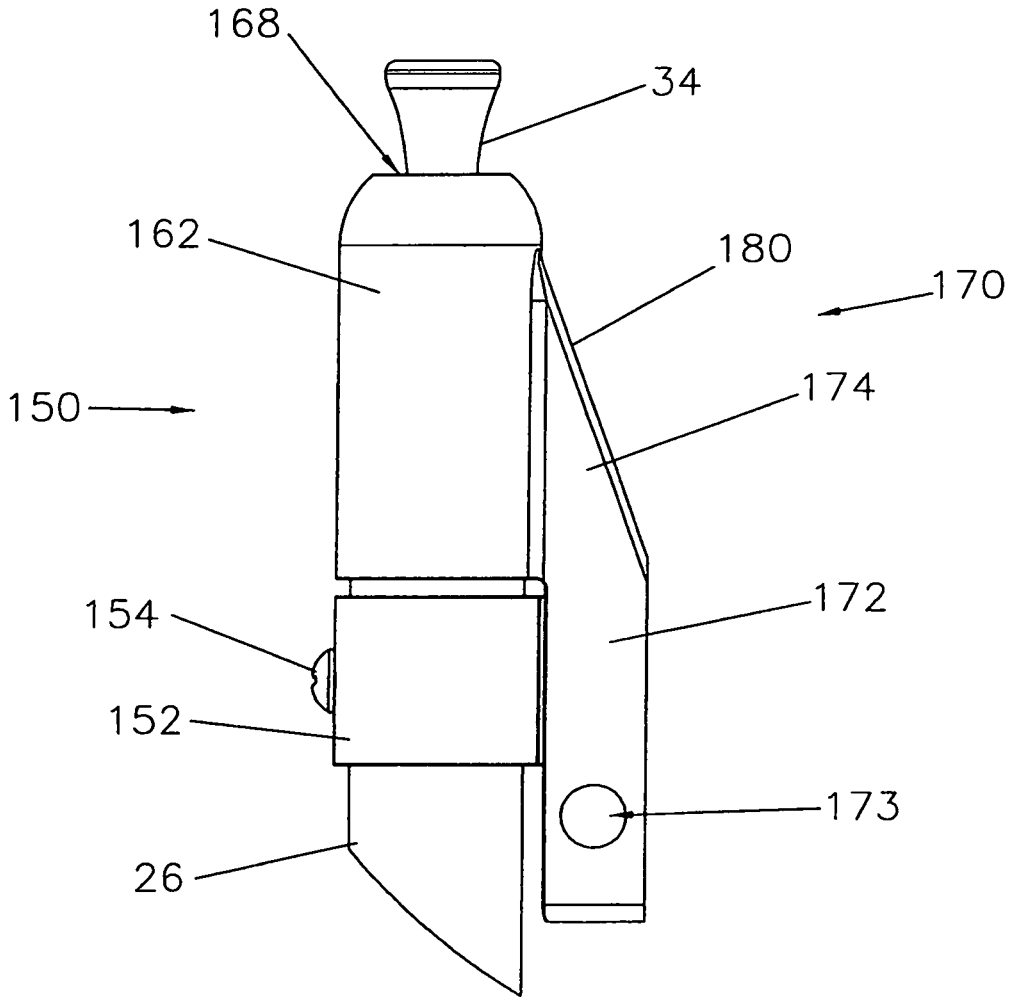
FIG. 14 is a side view of the pull lock in the unlocked position.

As shown in FIGS. 13 through 15, when in the first or unlocked configuration, the upper hollow actuator pull knob shroud 160 is in first or lower position such that the upper actuator pull knob or member 34 extends or is disposed above the upper hollow actuator pull knob shroud 160 so that the latch assembly 12 may be pulled upward from the first to second position causing the latch engaging member or lower surface 106 of the substantially vertical latch actuator 102 to engage the latch actuator surface 89 of the inner latch member 88 of the pivotal latch member rotating the pivotal latch member 47 from the first to second position allowing the striker pin 49 of the keeper assembly 16 to clear the pivot latch member 47 such that the gate (not shown) can swing open (FIG. 12).

As shown in FIGS. 16 through 18, when in the second or locked configuration, the upper hollow actuator pull knob shroud 160 is in the second or upper position such that the upper actuator pull knob or member 34 is disposed within the upper hollow actuator pull knob shroud 160 to prevent access to the upper actuator pull knob or member 34. The lock receiving aperture 150 and lock aperture 173 are axially aligned relative to each other to receive a pad lock (not shown) or similar locking device to lock or secure the upper hollow actuator pull knob shroud 160 in the second or upper position to maintain the latch locking assembly 150 in the locked configuration.

Due to the size and shape of the upper latch mount assembly 96, the lower latch mount assembly 98 and the striker latch mount assembly 112, the top pull gravity latch device 10 can be mounted to fence posts 14 and gate posts 18 of various sizes and shapes without modifying the structure of the top pull gravity latch device 10 or any of the structural components.

Figure 10:
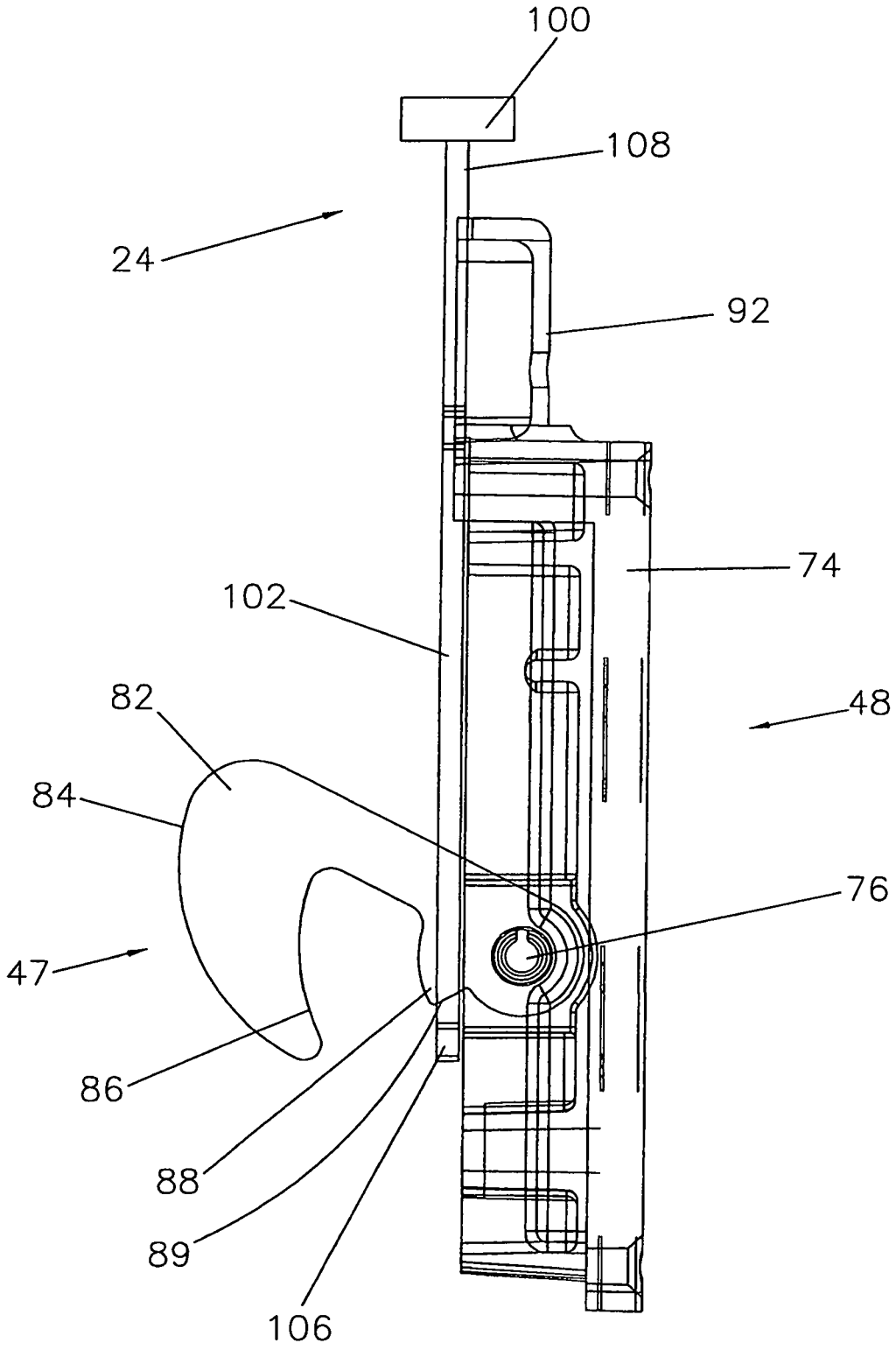
FIG. 10 is a side view of the latch assembly with the latch member of the present invention with the latch member in the first position.
Figure 11:
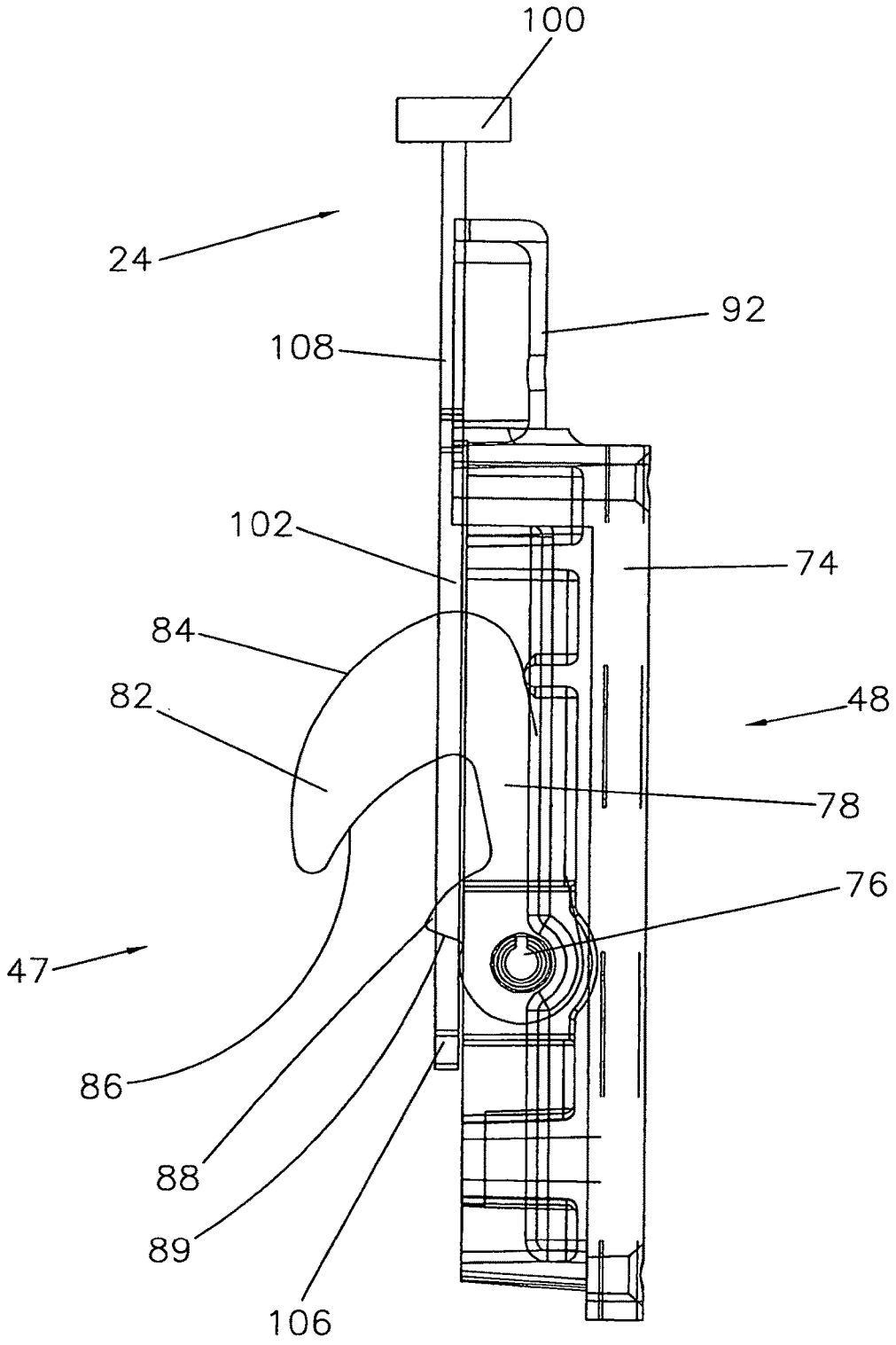
FIG. 11 is a side view of the latch assembly with the latch member of the present invention with the latch member in the second position.

As shown in FIGS. 6, 9 and 10, the latch actuator surface 89 of the inner member or knob 88 is disposed beneath and in spaced relationship relative to the pivot actuator surface 106 when the latch actuator assembly 20 is in the first position such that the pivot latch member 47 is operable independent of the latch actuator assembly 20 and the latch actuator 102.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A gravity latch to selectively secure a gate in a closed position to block the opening or portal in a fence, wall or other barrier comprising a latch assembly including a latch actuator assembly including an upper pull knob, an elongated interconnecting member having an upper end and a lower end and an elongated member having an upper end and a lower end and including a latch slot with a pivot actuator surface formed therein said upper pull knob attached to said upper end of said elongated interconnecting member and said lower end of said elongated interconnecting member is coupled to said upper end of said elongated member and a keeper latch assembly including a pivot latch member having a latch actuator surface, said latch actuator assembly and said pivot latch member each movable between a first position and second position, and a keeper assembly movable between a first or closed position and a second or opened position including a striker wherein said latch slot is disposed to receive said pivot latch member, said pivot actuator surface of said latch actuator assembly is disposed to selectively engage said latch actuator surface of said pivot latch member when said is moved from said lower position to said upper position moving said pivot latch member from said first position to said second position clearing said striker from said keeper latch assembly allowing said keeper assembly to be moved from said first position to said second position to allow the gate to be opened and when said latch actuator assembly and said pivot latch member are each in said first position said keeper assembly is secured in said first or position to lock the gate in the closed position.

2. The gravity latch of claim 1 wherein said latch actuator assembly is at least partially disposed within a latch assembly housing comprising a hollow sleeve having a cap formed on an upper portion of said hollow sleeve and including a centrally disposed hole to receive an upper portion of said latch actuator assembly therethrough.

3. The gravity latch of claim 1 wherein said pivot latch member comprises an inner lever arm including a hole formed therethrough to receive a pivot pin having an outer member formed on an outer end portion thereof including a convex striker pin cam surface, an inner concave striker pin retainer surface and an inner member extending downwardly from a midportion thereof including said latch actuator surface to form a striker pin recess therebetween to receive said striker pin therein when said pivot latch member is in said first position and said keeper assembly is in said first or closed position.

4. The gravity latch of claim 1 wherein an upper portion of said elongated member is coupled to a lower portion of said interconnecting member by an inverted cup including a retainer ledge formed on said interconnecting member to support a disk on said elongated member.

5. The gravity latch of claim 1 further including a latch locking assembly comprising a first lock member affixed to said latch assembly housing and a hollow shroud including an aperture formed in an upper portion thereof to receive an upper portion of said elongated member therethrough and having a second lock member mounted on said upper portion of said latch actuator housing, said hollow shroud movable between a first or unlocked position and a second or locked position such that when said hollow shroud is in said first or unlocked position said pull knob is disposed above said hollow shroud to permit access to said pull knob and when said hollow shroud is in said second or locked position, said pull knob is disposed with said hollow shroud to prohibit access to said pull knob.

6. The gravity latch of claim 5 wherein said first lock member comprises a flange extending outwardly from said latch assembly housing including a first lock receiving aperture and said second lock member comprises at least one flange extending outwardly from said hollow shroud including a second lock receiving aperture such that when said hollow shroud is in said second or locked position said pull knob is disposed within said hollow shroud to prevent access to said pull knob and said first locking receiving aperture and said second lock aperture are axially aligned relative to each other to receive a lock to secure said hollow shroud to said latch assembly housing in said second or locked position to maintain said latch locking assembly in a locked position.

7. The gravity latch of claim 6 wherein said second lock member comprises a pair of substantially parallel flanges cooperatively forming a slot to receive said first lock member therethrough.

8. The gravity latch of claim 1 wherein said keeper assembly comprises said keeper and a striker pin coupling assembly mounted to the gate post by a keeper mount assembly.

9. The gravity latch of claim 8 wherein said striker pin coupling assembly comprises a bracket having a connector including a striker pin alignment key extending outwardly therefrom to engage said keeper mount assembly to operatively align said striker pin coupling assembly relative to said keeper latch assembly.

10. The gate latch of claim 8 wherein said striker pin alignment key includes a plurality of threads formed on the surface thereof to engage an externally threaded adjustment member coupled to said keeper mount assembly to selectively adjust the horizontal distance between said striker pin and the gate post.

11. The gate latch of claim 1 wherein said latch actuator surface is disposed beneath and in spaced relationship relative to said pivot actuator surface when said latch actuator assembly is in said first position such that said pivotal latch member is operable independent of said latch actuator assembly.

12. The gravity latch of claim 1 further including a mount assembly to couple said latch assembly to the fence post and a keeper mount assembly to couple said keeper assembly to the gate, wherein said latch mount assembly includes a concave base affixed to the fence post having a radius of curvature less than the radius of the fence post and secured to the fence post by a flexible tie element tightly secured around the fence post and said keeper mount assembly includes a concave base affixed to the gate post having a radius of curvature less than the radius of the gate post and secured to the gate post by a flexible tie element tightly secured around the gate post.

* * * * *